US012533002B2

(12) United States Patent
Ballesteros et al.

(10) Patent No.: US 12,533,002 B2
(45) Date of Patent: Jan. 27, 2026

(54) ANCHORING AND RELEASE SYSTEM TO SECURE A LIQUID RELEASING TUBE INTO A LOW-FLOW DEVICE

(71) Applicant: Geyser Technologies, LLC, Montrose, CO (US)

(72) Inventors: Jonathan M. Ballesteros, Montrose, CO (US); Ian M. Anderson, Montrose, CO (US)

(73) Assignee: Geyser Technologies, LLC, Montrose, CO (US)

( * ) Notice: Subject to any disclaimer, the term of this patent is extended or adjusted under 35 U.S.C. 154(b) by 0 days.

(21) Appl. No.: 19/032,440

(22) Filed: Jan. 20, 2025

(65) Prior Publication Data

US 2025/0160602 A1 May 22, 2025

Related U.S. Application Data

(62) Division of application No. 17/983,696, filed on Nov. 9, 2022, now Pat. No. 12,232,674.

(60) Provisional application No. 63/361,002, filed on Nov. 18, 2021.

(51) Int. Cl.
*A47L 13/26* (2006.01)
*A47L 13/16* (2006.01)
*A47L 13/50* (2006.01)

(52) U.S. Cl.
CPC ..... *A47L 13/26* (2013.01); *A47L 13/16* (2013.01); *A47L 13/50* (2013.01)

(58) Field of Classification Search
CPC ..... A47L 13/26; A47L 13/16; A47L 13/50; A47L 13/00; A47L 13/17; A47L 13/10
USPC ..... 401/201, 203, 204, 207
See application file for complete search history.

(56) References Cited

U.S. PATENT DOCUMENTS 3,368,233 A * 2/1968 Lemberger ..... A47K 7/028 401/196
3,617,139 A * 11/1971 Ross ..... A47L 13/22 401/292
4,240,760 A * 12/1980 Levine ..... A47K 7/03 510/142
4,665,580 A * 5/1987 Morris ..... A47L 13/17 15/244.4
2008/0166178 A1* 7/2008 Alarcon Grajeda ..... A47K 7/03 401/201
2009/0255078 A1 10/2009 Wada et al.
2018/0042439 A1 2/2018 Policicchio et al.

* cited by examiner

*Primary Examiner* — David J Walczak
(74) *Attorney, Agent, or Firm* — Sutton Magidoff Barkume LLP

(57) ABSTRACT

A scrub body, a scrub anchoring system, and a method for securing and releasing a tube coupler into and from a scrub body. The scrub body can comprise two portions, or regions, within a single, unibody sponge-like material or as two similar or dissimilar layers within the sponge-like material. The scrub body includes an anchoring pocket extending into the scrub body between the portions, regions or layers, to accommodate a tube coupler releasably secured inside the anchoring pocket. The scrub body with anchoring pocket can be discarded when worn out while the more expensive tube coupler can be readily removed from the anchoring pocket and re-inserted into a new scrub body to provide the same low-flow liquid releasing tube into a new scrub body.

5 Claims, 3 Drawing Sheets

ANCHORING AND RELEASE SYSTEM TO SECURE A LIQUID RELEASING TUBE INTO A LOW-FLOW DEVICE

TECHNICAL FIELD

The present disclosure generally relates to a washing and cleaning system that receives fluid from a fluid delivery system, possibly regulated to a low-flow delivery rate.

BACKGROUND OF THE INVENTION

Washing or cleaning systems often utilized a sponge. The sponge can be used to sop up or lift a fluid, such as water or a combination of water with a cleaning or washing additive. A sponge used to absorb or lift a liquid or fluid can be made from a porous material having a substantial number of closed pores within the body of the sponge. The pores absorb the fluid by lifting the fluid into the sponge body when washing a surface. The lifted fluid is typically a washing concentrate that has been previously applied but must later be absorbed or lifted from the cleaned surface.

Another application of a sponge is to apply fluid into the sponge body as the sponge is wiped across a relatively dry surface. In this application, the fluid is applied as the sponge is scrubbed across the surface. The sponge primary purpose is therefore not to sop up fluid but to apply fluid to the surface as the sponge undergoes a scrubbing action.

Depending upon whether the fluid is applied to the surface prior or during sponge application, the sponge can have different shapes and sizes. Moreover, depending on the surface on which the sponge is applied, the sponge can also have different compositions. Unique problems occur when using the sponge in a portable washing or cleaning system. For example, such systems often are coupled to a fluid delivery system that delivers fluid under reduced pressure at relatively low flow rate. Portable washing and cleaning systems coupled to low-flow delivery systems often cannot apply enough fluid to a washing or cleaning sponge to properly clean the targeted surface. A need therefore exists in providing either an at-home washing and cleaning sponge capable of receiving a residential flow rates and pressure, or a portable washing and cleaning sponge that receives fluid from a gravity bag, pump or regulated fluid delivery system and can nonetheless properly clean without receiving relatively large amounts of fluid pressure or flow therefrom. There is further need for a sponge that can receive lesser quantities of fluid pressure or flow into the sponge itself as the sponge is scrubbed across a target surface. A need also exists in securing a tube coupler into the scrub itself in an easy, cost effective, releasable and re-usable fashion.

SUMMARY OF THE INVENTION

In one embodiment disclosed herein, a scrub body is provided. The scrub body is that of a sponge for receiving a fluid, or liquid, as the scrub body is applied to a target surface in a scrubbing motion. Accordingly, the scrub body is not used to mop up or lift away fluid, but instead is used to contain fluid delivered to the scrub body and then from the scrub body to the surface. The scrub body preferably comprises two portions of material separated at an opening along a sidewall surface of the scrub body.

The opening can be a slit that extends only partially between the two portions. The two portions can be formed together of the same material, and of unibody construction, with the slit opening formed between two major opposed planar faces of the scrub body. Alternatively, the two portions can be two layers of the same or dissimilar material secured together around an entire perimeter of the scrub body except at the opening. For example, the slit can extend between two layers of similar material of similar roughness and texture, with a third layer secured to one of the two similar layers around the perimeter of the scrub body except at the opening. The third layer can be dissimilar in roughness and texture than the layer on which it is secured with different roughness and texture than either of the two layers of similar material surrounding the slit. Likewise, if the slit exists between two layers of dissimilar material, the roughness and texture of those two dissimilar layers is different.

An anchoring pocket extends into the scrub body between the two portions. The anchoring pocket extends from the opening at the sidewall of the scrub body and into the scrub body. The anchoring pocket comprises lateral sidewall surfaces. The lateral sidewall surfaces extend from the opening laterally outward from a pocket central axis and then inward toward the pocket central axis. The anchoring pocket therefore comprises opposed concave sidewall surfaces separated with the opening at one end of the opposed concave sidewall surfaces. The opening can be of variable opening distance as measured perpendicular to two major planar faces depending on an amount of force applied parallel to the two major planar faces. For example, the opening can start as a slit opening of relatively small opening distance as measured perpendicular to the two opposed planar faces. However, when force is applied parallel to the two opposed planar faces, the slit becomes more oval shaped that becomes almost circular shaped when maximum force is applied between the two opposed planar faces.

In another embodiment, a scrub anchoring system is provided. The scrub anchoring system comprises a scrub body of two portions of material separated at the opening, with an anchoring pocket extending partially between the two portions from that opening and between the two opposed concave sidewall surfaces. The scrub anchoring system also comprises a tube coupler that includes a hollow coupler body terminating at opposed male couplers. The male couplers can include one or more barbs that extend radially outward from a central axis of each male coupler. The tube coupler also includes a pair of continuous, seamlessly coupled unibody wings arranged on a midpoint of the coupler body equidistant from the opposed male coupler, or barbs, and comprising an aperture at a central axis of the wings aligned co-linear with the opposed male barbs. The wings are configured to flex in an arcuate pattern while the distal ends abut against the opposed concave sidewall surfaces as the tube coupler is placed inside the anchoring pocket. The distal ends of the wings therefore flex away from the central axis of the wings and against the opposed concave sidewall surfaces when the tube coupler is placed inside the anchoring pocket.

The distal ends of the wings comprise wing apertures configured to receive a string that, when pulled, flexes the distal ends of the wings toward the central axis of the wings and away from the opposed concave sidewall surfaces. Bending the distal ends of the wings away from the sidewall surfaces allows the tube coupler to be released from the anchoring pocket. The pair of wings can be coupled between a pair of tube stops that radially extend from the coupler body. Each tube stop is dimensioned to stop a distal end of a tube inserted onto the tube coupler and specifically onto the corresponding male coupler or barb. Alternatively, the pair of wings can be molded around and within a mold securement aperture extending through the coupler body equidistant from the opposed male barbs.

The opposed male coupler, which can be barbs, are dimensioned to securely receive a pair of fluid delivery tubes. One of the pair of fluid delivery tubes can extend from the scrub body when the tube coupler is placed inside the anchoring pocket, and the other one of the pair of fluid delivery tubes extends further into the scrub body when a tube coupler is placed inside the anchoring pocket. The fluid delivery tubes are dimensioned to provide up to 3.0 gallons per minute (gpm). However, performance of the present system is sufficiently efficient to ensure a 0.2 to 0.5 gpm is all that is needed to qualify as a low-flow delivery system into a low-flow scrub device. Preferably, the fluid delivery tubes inserted over the opposed male barbs and into the scrub are dimensioned with an inside diameter less than approximately 20 mm for residential, at-home shower wand plumbing systems regulated downward in flow to meet a low flow delivery. Alternatively, the inside diameter can be less than 10 mm for portable water delivery systems such as non-home gravity bags, pumps and pressurized water chambers.

According to yet another embodiment, a method is provided for securing and releasing a tube coupler into and from a scrub body. The method includes aligning the tube coupler with an anchoring pocket opening within the scrub body. The tube coupler can then be inserted through the opening and into the anchoring pocket. Flexible wings of the tube coupler are expanded against sidewall surfaces of the anchoring pocket as the tube coupler is inserted. Because the sidewall surfaces are opposed concave surfaces, once the distal ends of the wings reach the apex of the concave, the wings become more difficult to further insert into the anchoring pocket and the securement is then complete. The distal ends of the flexible wings of the tube coupler can be grasped to cause bending of the flexible wings away from the sidewall surfaces of the anchoring pocket. The tube coupler can then be drawn from the opening to complete the releasing of the tube coupler from the scrub body.

According to one exemplary embodiment, expanding the flexible wings comprises frictionally pressing the flexible wings in a less arcuate position as the distal ends of the flexible wings slide along sidewall surfaces of the anchoring pocket. The sidewall surfaces therefore cause the flexible wings to bend further as they slide along those sidewall surfaces. Conversely, when removing the tube coupler, a string coupled to each of the distal ends of the wings can be pulled while holding the tube coupler within the anchoring pocket. Pulling of the string coupled to the distal ends while holding the tube coupler will cause the wings to reshape into a more arcuate curvature away from the sidewall surfaces of the anchoring pocket to thereby allow release of the tube coupler and drawing of the tube coupler from the anchoring pocket and thus from the scrub body.

Embodiments described herein comprise a combination of features and characteristics included to address various shortcomings, including shortcomings of cleaning or scrubbing a surface with a low-flow scrub device. The anchoring pocket feature within a scrub body allows for a tube coupler to be easily inserted and thereafter easily released so that the tube coupler can be re-used in another scrub body having the same anchoring pocket system. This allows for the fairly inexpensive scrub body to be quickly and easily separated from a more expensive tube body, and the used scrub body to be readily discarded after its useful life has expired. The tube coupler allows an end user to secure a tube within an inexpensive, replaceable sponge. After use, the tube is easily removed from the used, or expired, sponge so that the user can add a new and inexpensive sponge body with the present anchoring pocket system. The inexpensive manufacturing steps needed to produce this scrub body coupled with the easily and securely fixed tube coupler system overcomes many disadvantages of conventional low-flow washing and cleaning systems.

BRIEF DESCRIPTION OF THE DRAWING

For a detailed description of various exemplary embodiments, reference will now be made to the accompanying drawings in which.

DETAILED DESCRIPTION OF THE INVENTION

Figure 2A:
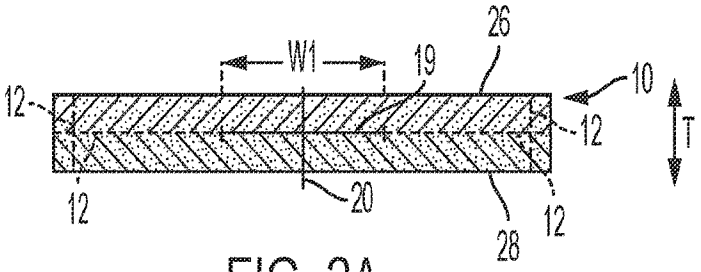
FIG. 2*a* is a side view along plane 2-2 of FIG. 1 with the anchoring pocket closed within a layered or non-layered scrub body.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., x, y or z direction or central axis of a body, outlet or port), while the terms "radial" and "radially" generally mean perpendicular to the given axis. For instance, an axial distance refers to a distance measured along or parallel to the axis, and a radial distance means a distance measured perpendicular to the axis.

As used herein, the terms "about," "approximately," substantially," "generally," and the like mean plus or minus 10% of the stated value or range. In addition, as used herein, a low-flow device refers to a cleaning or washing device, such as sponge, that receives low pressures and flow rates from a fluid delivery source that preferably delivers fluid at a low-flow, low-pressure to a tube coupler releasably attached to a scrub body. The low-flow amount of the liquid or fluid delivered to the low-flow device or scrub, arrives from a residential or portable fluid source that delivers fluid at a flow rate preferably less than approximately 0.5 gallons per minute (gpm), and preferably at a pressure less than 100 psi, and more preferably less than 60 psi. The low-flow pump delivers fluid into a relatively small conduit or flexible hose. The flexible hose can be made with any pliable material, such as rubber or the like, having a relatively small inner diameter. According to one example, the cross-sectional inner diameter of the tube can range anywhere from 2 to 20 mm, and preferably is less than 6 mm depending on whether the scrub anchoring system deliver fluid in a residential or portable environment. The flexible tube can be placed into a flexible low-flow device, such as scrub body, or alternatively into a flexible rag, pouf, dressing, brushes, or into any scrub device that can receive fluid as it is moved or scrubbed across a surface, such as a user's body.

A scrub body that can be made of a single, unibody construction of the same material. According to an alternative embodiment shown in FIG. 1, however, scrub body 10 is shown made of two different types of material coupled together as two layers. In the latter embodiment shown in FIG. 1 scrub body 10 of two or more layers are coupled together along the dashed lines 12. The dashed line can represent the two or more layers sewn together with stitching that penetrates the two or more layers along the edges of the major planar faces of each layer. Each layer as measured along their planar faces has the same height H and width W. The thicknesses of each layer, however, can be different, as will be shown in FIG. 2*b*. Alternatively, the layers can be coupled together with a bonding material placed along the dashed lines 12. The bonding material can be an adhesive that secures the two or more layers together. The dashed lines 12 represent the locations in which the layers are coupled together. Only in those dashed line regions are the layers coupled together, leaving the layers between line 12 separate from one another and as will be described below, capable of being separated or opened.

Figure 2B:
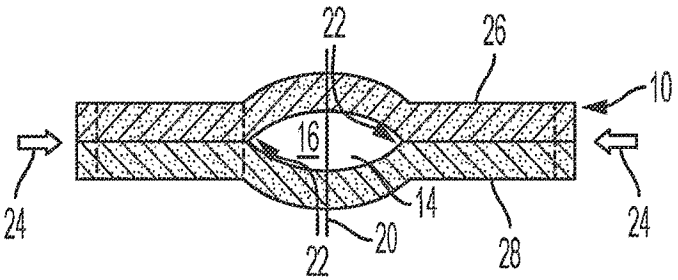
FIG. 2*b* is a side view along plane 2-2 of FIG. 1 with the anchoring pocket opened within a layered scrub body.
Figure 1:
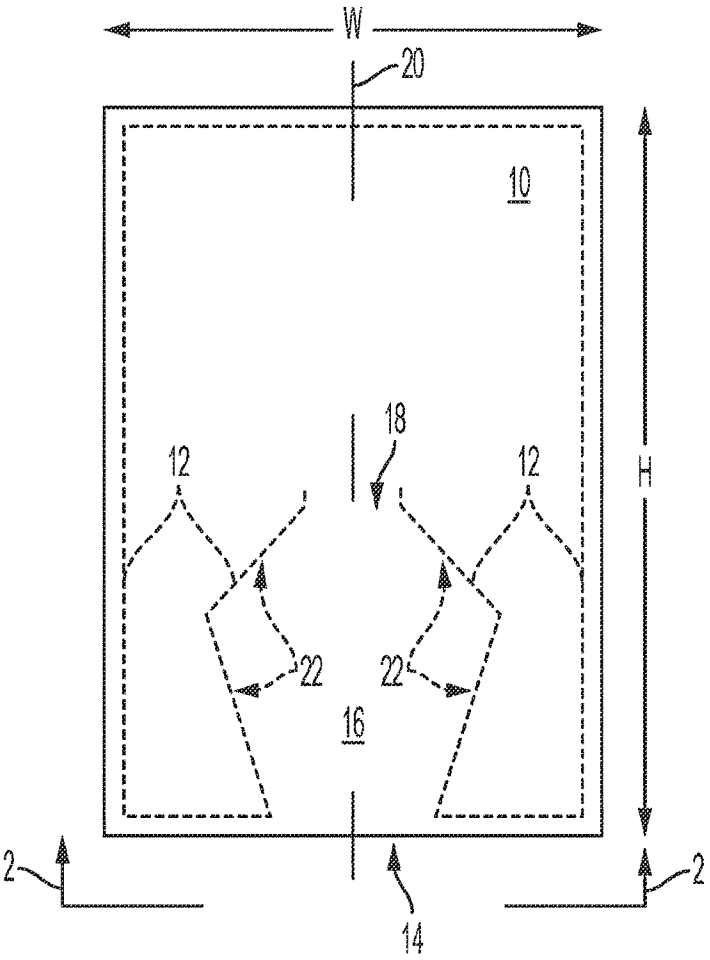
FIG. 1 shows a scrub body having an anchoring pocket configured to be opened inside the scrub.

FIGS. 1 and 2*b* illustrates an anchoring pocket 16 extending between the layers from opening 14 and inward into the scrub body 10. The opening 14 is a primary opening, and primary opening 14 exists only partially along a sidewall surface of scrub body 10. The sidewall surface is perpendicular to the opposed major planar faces of each layer. A secondary opening 18 exists at another end of anchoring pocket 16 opposite the primary opening 14.

The anchoring pocket 16 extends between layers from opening 14 laterally outward from anchoring pocket central axis 20 along coupling line 12 and then inward toward the pocket central axis 20 along line 12. Anchoring pocket 16 therefore has a sidewall surface defined by the coupling of layers along line 12 that faces pocket 16 symmetrical about pocket central axis 20 and between primary and secondary openings 14 and 18. Thus, the coupling of the two or more layers along line 12 but inside of the perimeter coupling location forms the sidewall surface of anchoring pocket 16. Those sidewall surfaces are shown with reference numeral 22 as being concave sidewall surfaces separated with the opening 14 at one end and the opposed secondary opening 18 at the other end. The primary opening is needed for insertion of a tube coupler into the scrub body 10, and the secondary opening 18 is needed for insertion of a tube distal end, previously coupled to and extending from the tube coupler, to further extend into the scrub body 10.

FIG. 2*a* is a side view along plane 2-2 of FIG. 1. Plane 2-2 is parallel to the sidewall surface of the scrub body 10 yet perpendicular to the two major opposed planar faces of the scrub body 10. The thickness T of the sponge body is between 0.65-80 mm. The side view of FIG. 2*a* illustrates the instance in which the opening 14 is merely a slit 19 that only partially extends along the tube body a width W1. FIG. 2*a* illustrates one embodiment in which two portions of similar material can be distinguished from one another by a line in phantom extending along the same plane as the slit 19 between the two major opposed planar faces. The two portions each have opposed major planar faces 26, 28 of the same material but separated by slit 19 and an imaginary co-planar extension of slit 19 parallel and between the opposed planar faces.

FIG. 2*a* illustrates according to an alternative embodiment two layers having respective opposed planar faces 26, 28 separated by slit 19, and also separated by a co-planar (shown as the dashed line along the sidewall surface) to the slit demarcation between the two major opposed planar faces. The two layers are shown secured together at internal bond or stitch locations 12. The two (or more) layers can be of the same or different material, each being deformable to differing degrees and each preferably having different roughness and texture. If the two layers are of different material, one layer can be made of a relatively soft polyurethane foam having a substantial portion being a closed cell design. Another layer can be made of a more abrasive material having a honeycomb or open pore design, possibly made of cellulosic sponge, tissue with or without abrasive fibers or particles added to the open pore layer. In this fashion, whether two or more layers exist, one layer on one major planar surface of scrub body 10 can have an abrasive plastic-type open cell or honeycomb design with abrasive particles layered or coated onto that major planar surface. The other opposing layer on the opposite major planar surface can be made of a softer material having less roughness and smoother texture than the opposite major planar surface. Thus, the opposed surfaces are made of different material used for different cleaning purposes and include a natural cellulose material, a synthetic material, microfiber material, abrasive materials or foam equivalent materials with different impregnated abrasive compounds placed therein. If the two layers are similar, coupled to one of the similar layers is a third layer made of dissimilar material than the two layers. For example, the slit can exist between two layers of natural cellulose, with the third layer of rough plastic sheet. The rough sheet would exist on one major planar surface side of one of the similar layers made of cellulose and the other similar layer represents the softer side of the sponge body opposite the rough plastic sheet on the opposite side.

Referring back to FIG. 1, scrub body 10 preferably is a rectangular shape, approximately 120-160 mm×80-120 mm in height H×width W. The shorter end width W, nominally 100 mm is left open and not bonded or stitched together at opening 14. The separation at opening without lateral compression on the sidewall surface extends as a slit partially along the sidewall surface approximately 0.5 to 1 inch.

FIG. 2*b* illustrates a side view along the plane 2-2 of FIG. 1, according to the two-layered embodiment, with the anchoring pocket 16 opened within a layered scrub body 10. Pocket 16 presents itself as the flexible or pliable scrub body 10 compressed laterally in the directions 24. Essentially, scrub body 10, with compressed along direction 24 causes the two or more layers to separate along slit 19 in a direction perpendicular to the layered two major planar faces 26 and 28 of the opposed outside surfaces of the scrub body 10. The perpendicular separation of the two major planar faces 26 and 28 along slit 19 causes an opening 14 to appear and the laterally extending sidewall surfaces 22 of pocket 16 to also appear. Opening 14 further opens from a slit 19 perpendicular to the major planar faces 26 and 28 at a pocket central axis 20 and radially outward from that central axis 20. The amount of opening 14 is dependent on the amount of pressure applied in the directions 24. The greater the force in directions 24, the greater slit 19 is opened for creating a fully opened opening 14, and also creating a larger ingress into the anchoring pocket 16.

Figure 2C:
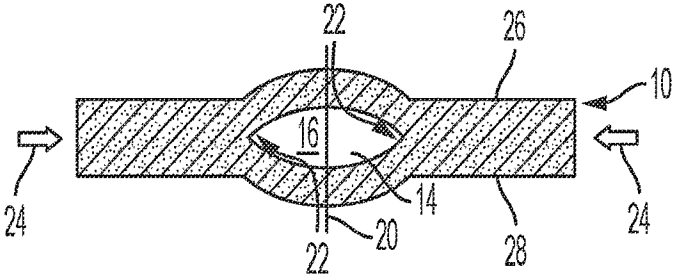
FIG. 2*c* is a side view along plane 2-2 of FIG. 1 with the anchoring pocket opened within a unibody scrub body.

FIG. 2*c* illustrates the anchoring pocket opened within a single material or bonded multi-material unibody scrub body 10. Instead of two or more layers coupled together along the periphery and along the sidewall surfaces of the anchoring pocket, the anchoring pocket can be formed by compressing the scrub body 10 along directions 24 thereby forcing slit 19 to further open as opening 14. The slit 19 of FIG. 2*a* is formed substantially parallel between opposed major planar surfaces 26 and 28 and along that parallel plane inward into scrub body 10 but only partially along the sidewall surface. Thus, the scrub body 10 can be made of one piece, a unibody piece, from a die-casting process with a slit formed into the unibody material to derive essentially two portions yet each portion is nonetheless the same unibody. At slit 19, a part of one portion can extend perpendicular outward from one major planar surface while another part of the other portion can extend opposite and outward from the second major planar surface to form opening 14. Thus, although the two portions are described as two portions, they are nonetheless the same material or molded materials yet with a slit partially between them. Similar to the uncoupled, or unstitched opening, the slit in the unibody material of FIG. 2*c* embodiment and the approximately 0.5 to 1 inch long slit along the sidewall surface of scrub body 10 extending from opening 14 to the secondary opening 18 and beyond, is shown in further detail in FIG. 4.

Figure 3:
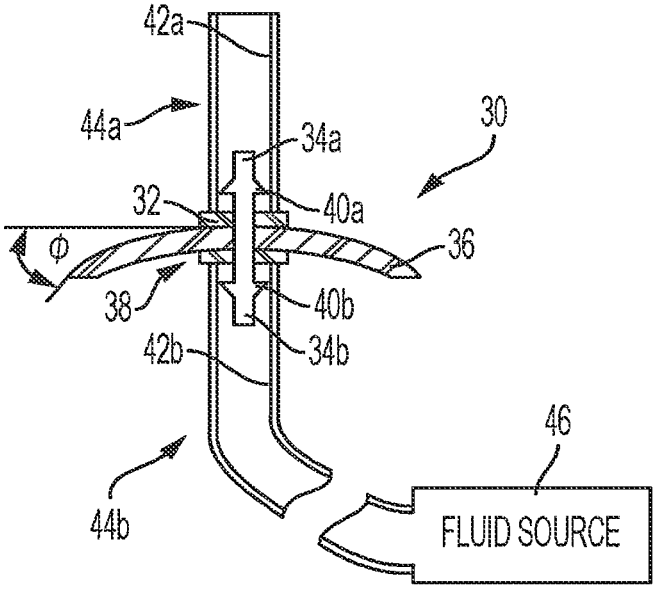
FIG. 3 is cross-sectional view of a tube coupler configured to be securely placed inside the anchoring pocket of the scrub body.

Turning now to FIG. 3, a tube coupler 30 is shown in cross section. Tube coupler 30 includes a hollow coupler body 32 terminating at opposed male barbs 34*a* and 34*b*. Arranged on a midpoint equidistance from the opposed male barbs 34*a* and 34*b* is a pair of wings 36. Although the pair of wings 36 are described as a pair, they are nonetheless of single unibody structure coupled to the midpoint 38. The male barbs 34*a* and 34*b* are hollow tubes, each having an outward extending protrusion 40*a* and 40*b* which engage with an inner surface 42*a* and 42*b* of a pair of hollowed tubes 44*a* and 44*b*. In addition to being hollow, tubes 44*a* and 44*b* can also be perforated. Tube 44*a* can be pre-cut approximately 3 inches in length, for example. Hollow tube 44*b* can also be pre-cut and is approximately 9 to 120 inches in length. While one end of tube 44*b* is secured to barb 34*b*, the other end is fluidly coupled directly or indirectly to a fluid delivery source 46, such as a residential water supply or a portable water supply. A portable water supply comprises a gravity bag, pump, pressurized water chamber, etc. Fluid delivery source 46 can deliver fluids that include a cleaning solution, or a mixture thereof. Fluid source 46 can be pressure and flow regulated, and also can contain restrictors and back flow preventers with automatic shut off timers and heaters, as well as possibly sanitation chambers to transport any type of fluid to a low-flow scrub body 10 via tube coupler 30. The diameter of tubes 44*a* and 44*b*, as well as the apertures through the hollow coupler body 30-32 and the hollow male barbs 34*a* and 34*b*, as well as the aperture through wings 36 are dimensioned so that a relatively low pressure, low fluid flow rate is maintained as the fluid is delivered from fluid source 46 into the low-flow scrub body 10. The interior diameter of tubes 44*a* and 44*b* can be less than 20 mm, and preferably less than 10 mm. The hollow coupler body, as well as the apertures of the male barbs, are even smaller interior diameter to ensure a low-flow rate into the scrub body 10. The fluid flow rate delivered by low-fluid source 46 and through the coupler 30 is preferably less than 0.5 gpm, with delivery pressure preferably less than 60 psi. The low-flow rates and low pressures ensure the relatively delicate coupler 30 and its coupling onto tubes 44*a* and 44*b* are not jeopardized or harmed in any way, and that coupler 30 and tubes 44*a* and 44*b* remain in their anchored position within low-flow scrub body 10 after they are inserted via arrow 48 into the opening 14 as shown in further detail in FIG. 4. However, given the strength at the coupling, the tubes 44*a* and 44*b* can remain coupled even at pressures nearly 100 psi and a delivery rate at 4 gpm. Before or after insertion of coupler 30, a cleaning material is inserted into the opening. The cleaning material can include a cleaning solution, water softening agent and/or therapeutic or aromatic-enhancing material.

Figure 4:
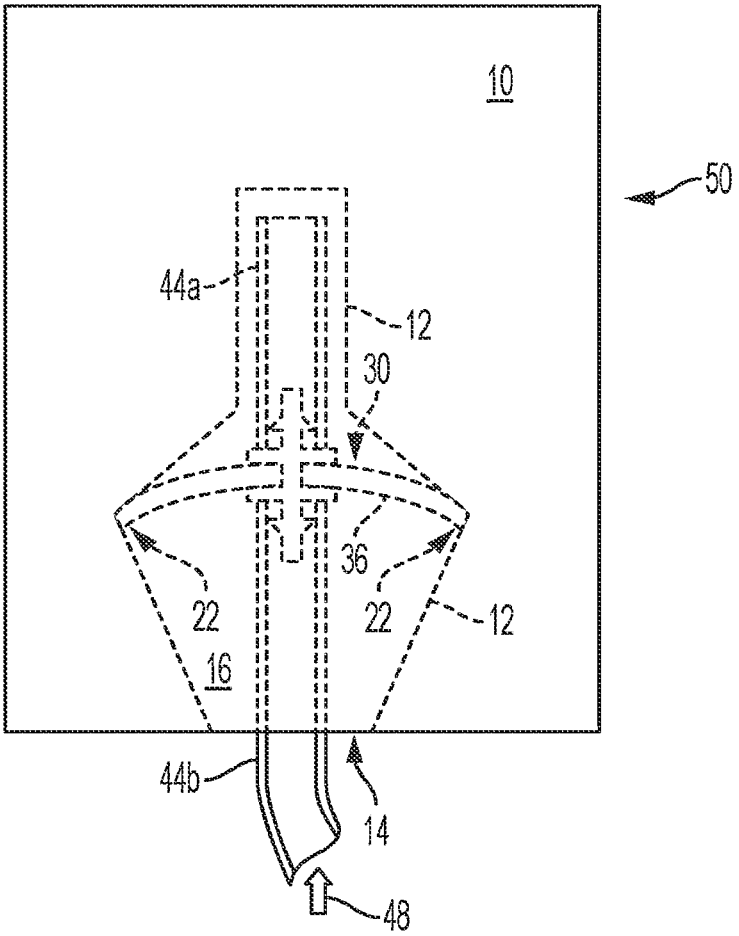
FIG. 4 shows the scrub anchoring system with the tube coupler (shown in phantom) anchored inside the anchoring pocket of the scrub body.

Turning now to FIG. 4, a scrub anchoring system 50 is shown. System 50 includes a scrub body 10 according to one embodiment. Scrub body 10 can include two portions of materials separated at an opening 14 that extends along the sidewall surface of sponge body 10. Opening 14 can initially be a slit within a sidewall surface of scrub body 10 between two major opposed planar faces 26 and 28 and thus between the two portions. The two portions can comprise the same material and are of the same unibody construction with the demarcation between the two portions simply that of different regions within that same unibody scrub body with no separation of the two except for a slit partially along the sidewall surface and extending into the scrub body 10.

As shown in FIG. 4, the slit extends into the scrub body 10 and parallel to the two major planar faces 26 and 28 as shown in FIG. 2*c*. As the slit progresses into scrub body 10 from opening 14, the lateral extent of the slit opening is shown by dashed line 12 thereby forming a pocket 16 having sidewall surfaces 22. The sidewall surfaces 22 are therefore interior of scrub body 10 between the two portions to securely but releasably maintain tube coupler 30 within anchoring pocket 16 via arrow 48. Specifically, the wings 36 are made of a flexible material that as the tube coupler is inserted into pocket 16, the wings flex backward and toward the proximal tube 44*b* and then, as the coupler 30 is inserted further into pocket 16, the wings 36 flex forward as they extend outward against the opposed concave sidewall surfaces 22 until they reach the outermost apex of that concave surface. Once wings 36 extend to their furthest distance laterally outward at the apex of the opposed concave sidewall surfaces 22, coupler 30 along with the distal tube 44*a* can no longer be inserted into pocket 16. Moreover, coupler 30, as well as its connected tubes 44*a* and 44*b* cannot be withdrawn since the seeded wings 36 are in an arcuate, fixed position against any withdrawal force. The wings 36 are thereby securely anchored along with the associated tubes 44*a*, 44*b* within pocket 16 until it is time for a user to release the coupler 30 from pocket 16 as will be described below. The curvature or backward arcuate curve of wings 36 ensures the attached coupler 30 remains in place. Preferably, the backward curvature of wings 36 as measured at the distal ends of the wings 36 is approximately at angle Ø between 0 and 85 degrees, and more preferably between 30 and 50 degrees, as shown in FIG. 3.

Although FIG. 4 illustrates a scrub body having two unibody constructed portions with a slit partially between those portions, an alternative embodiment is one shown in FIG. 1 where the two portions are two layers of dissimilar material secured together around an entire perimeter of scrub body 10 except at opening 14. Moreover, the sidewall surfaces 22 as shown in FIG. 1 can comprise two or more layers secured together. Although two layers can be secured together leaving a slit opening, or two portions can contain a slit, it is recognized that the opposed major planar surfaces of either embodiment can have a different roughness or abrasiveness placed on their outer surfaces. It is also recognized that additional portions or layers can be added to those two portions (layered or otherwise) of scrub body 10.

Figure 5:
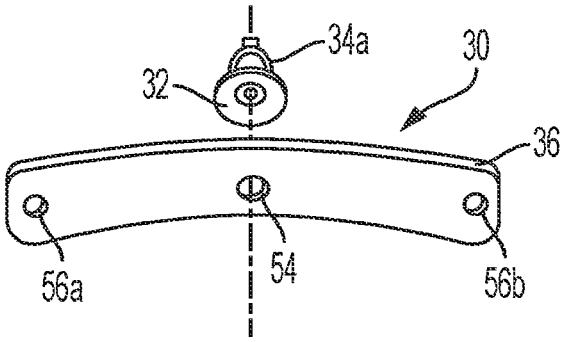
FIG. 5 is perspective, exploded view of a portion of the tube coupler and a pair of wings.

Turning now to FIG. 5, an exploded, perspective view of a portion of tube coupler 30 is shown. Although it is appreciated that tube coupler 30 has a hollow coupler body terminating as opposed male barbs, only one portion of the hollow coupler body 32 is shown terminating at male barb 34*a* in order to more clearly show the aperture 54. Hollow coupler body 32 has an aperture extending entirely through body 32 collinear with an aperture extending through male barb 34*a*, and also collinear with the central axis of an aperture 54 that extends entirely through wings 36. There is similar alignment with the apertures of the other portion of hollow coupler body 32 and male barb 34*b* not shown in FIG. 5 so that the aperture 54 can be more easily and clearly illustrated. The hollow coupler body 32, opposed hollow male barbs 34*a* and 34*b*, as well as the aperture 54 allows fluid delivery entirely through the tube coupler 30 from tube 44*b* to tube 44*a*, and therefore finally throughout scrub body 10 as shown in FIGS. 3 and 4.

In addition to aperture 54 arranged around a central axis of wings 36, additional apertures 56*a* and 56*b* can be placed through the entire distal ends of wings 36. According to one example, apertures 54 and 56*a*, 56*b* can be molded within wings 36 possibly at the same time in which wings 36 are molded about the midpoint of tube coupler 30. Alternatively, apertures 54 and 56*a*, 56*b* can be molded within wings 36, and wings 36 can thereafter be coupled onto the midpoint of tube coupler 30. Thus, wings 36, along with their apertures can be coupled to the hollow coupler body 32, or molded around and into the hollow coupler body 32 as will be illustrated in further detail in FIGS. 6 and 7.

Figure 6:
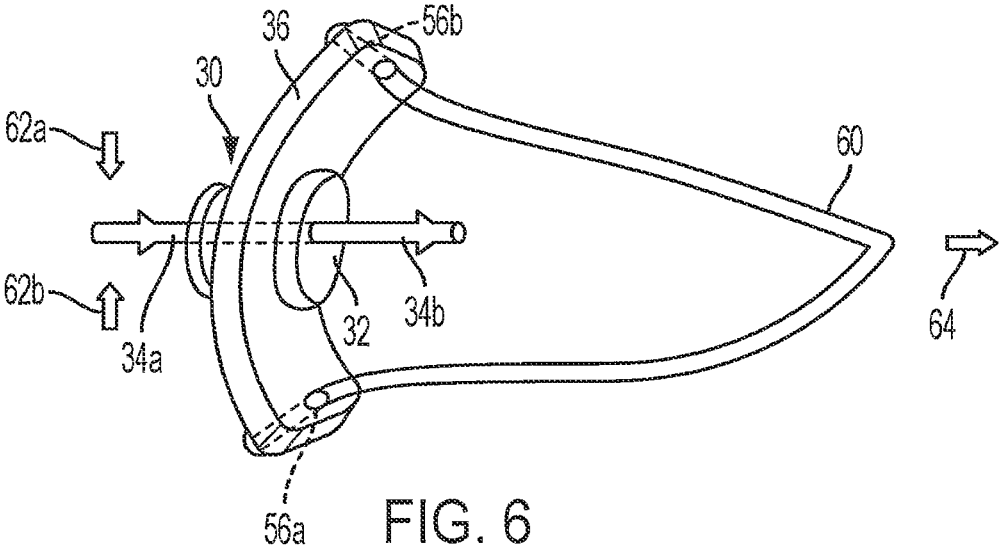
FIG. 6 is a perspective view of the tube coupler with a draw string coupled to distal ends of the wings, whereby the wings can be expanded against the anchoring pocket when inserted into the scrub body, and collapsed from the anchoring pocket when removed from the scrub body while a drawn string is pulled.

Turning now to FIG. 6, apertures 56*a* and 56*b* are dimensioned to accommodate a drawstring 60. Drawstring 60 can be secured through apertures 56*a* and 56*b* prior to insertion of wings 36, and thus the accompanying insertion of tube coupler 30 into anchoring pocket 16. After tube coupler 30 is secured via wings 36 inside anchoring pocket 16, drawstring 60 remains outside pocket 16, and specifically outside the sidewall surface of scrub body 10. When a user wishes to replace a worn out or damaged scrub body 10, rather than discarding the expensive tube coupler and tubes along with scrub body 10, the user need only pull on drawstring 60 in a direction away from scrub body 10 while at the same time pinching tube 34*a* between the two portions of scrub body 10 along force arrows 62*a* and 62*b*. Frictionally securing tube 34*a*, as well as the coupler 30 and wings attached thereto, while pulling drawstring 60 allows flexure of the distal ends of wings 36 backward and toward the central axis of the coupler as well as central axis 20 of the anchoring pocket 16. Further bending backward of the distal ends allows wings 36 to unseed from the outward apex of the sidewall surfaces 22. Once unseeded, the drawstring 60 can be further drawn along direction 64 away from opening 14 and scrub body 10 while releasing frictional engagement with tube 34*a*.

Use of a drawstring 60, and the method steps of pulling drawstring 60 while first securing tube 44*a* and thereafter releasing tube 44*a* provides an easy way in which to replace only the worn out scrub body 10 and not the reusable, more expensive tube coupler. Coupler 30 can be used for as many times as needed, however, scrub body 10 is designed to wear out. Due to its inexpensive cost to manufacture, scrub body 10 can be readily and easily replaced and thereafter secured or anchored with the reused tube coupler 30 with drawstring 60 attached. It is desirable that any grasping member, such as a drawstring 60, be secured to the distal ends of wings 36, to force the wings 36 to flex backward in a more arcuate position. The coupling therefore must be at the distal ends in order to effectuate that backward flexure of wings 36.

Figure 7:
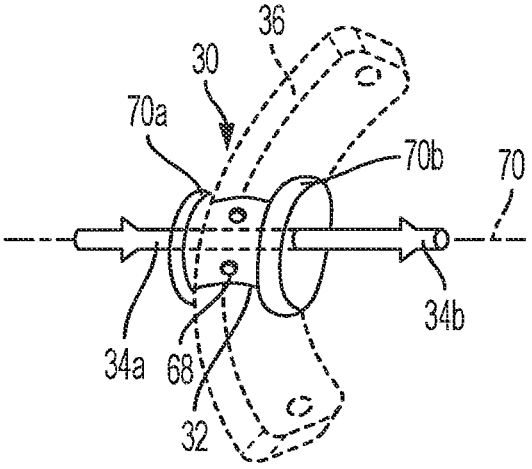
FIG. 7 is a perspective view of the pair of wings in phantom molded into and around at least one mold securement aperture extending through a midpoint of the coupler body.

FIG. 7 illustrates the pair of wings 36 in phantom to readily show one mechanism in which the coupler 30 can receive the wings. Coupler body 32, according to one embodiment can have one or more openings 68 extending at least partially through coupler body 32 in a direction perpendicular to the central axis 70 of tube coupler 30. Central axis 70 is the axis around which the coupler body 32 and the hollow opposed male barbs 34*a*-34*b* are aligned collinear therewith.

According to one embodiment, wings 36 can be coupled onto a midpoint of the hollow coupler body 32 via the perpendicular openings or apertures 68. Alternatively the wings 36 can be molded into apertures 68. The wings 36, coupled or molded, extend between tube stops 70*a* and 70*b* that radially extend from the central axis 70 from coupler body 32. If molded onto the midpoint between tube stops 70*a* and 70*b*, a portion of the mold which forms wings 36 extend into one or more apertures 68 to secure wings 36. If coupled, a securement member such as a screw can be placed through wings 36 and into apertures 68 after wings 36 are placed around the midpoint of the hollow coupler body 32. The coupler body 32 is preferably one piece, either including wings 36, or the wings 36 can be molded or coupled after the body 32 is formed. The wings 36, in either instance, are arranged onto the midpoint of the single, one piece coupler body 32 having opposed male barbs 34*a*, 34*b*. Alternatively, coupler body 32 can be two pieces secured together about wings 36 by snap fit or by coupling within apertures 68*a* screw that holds the two pieces of coupler body 32 together and within wings 36.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the slit that forms into a larger slit/opening exists between two or more portions of similar or dissimilar material, and wherein the portions can comprise similar or dissimilar unibody formed material or separately formed layers coupled together. If layers, at least two layers can comprise compressed cellulose. The compressed cellulose is designed to expand after fluid is delivered therein. The compressed cellulose can be more easily bonded together since it is stiffer than uncompressed cellulose, is of smaller package size for a less costly shipment footprint. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for securing and releasing a tube coupler into and from a scrub body, comprising:

aligning the tube coupler with an anchoring pocket opening within the scrub body;

inserting the tube coupler through the opening and into the anchoring pocket;

expanding flexible wings of the tube coupler against sidewall surfaces of the anchoring pocket to complete securing of the tube coupler;

grasping distal ends of the flexible wings of the tube coupler;

bending the flexible wings away from the sidewall surfaces of the anchoring pocket; and drawing the tube coupler from the opening to complete releasing of the tube coupler.

2. The method of claim 1, further comprising inserting a cleaning material through the opening and into the anchoring pocket or scrub body before inserting the tube coupler.

3. The method of claim 1, wherein the inserting comprises directing the tube coupler through the opening and between two layers of material secured around an entire perimeter of the scrub body except at the anchoring pocket opening.

4. The method of claim 1, wherein the expanding comprises flexing the flexible wings in a less arcuate position as the distal ends of the flexible wings slide along sidewall surfaces of the anchoring pocket.

5. The method of claim 1, wherein the grasping comprises pulling a string coupled to each of the distal ends, and wherein bending comprises pulling the string coupled to each of the distal ends while holding the tube coupler within the anchoring pocket to reshape the flexible wings into a more arcuate curvature away from the sidewall surfaces of the anchoring pocket.

* * * * *